United States Patent [19]

Smith

[11] Patent Number: 4,623,279

[45] Date of Patent: Nov. 18, 1986

[54] PREHEATER FOR ROAD STRIPE APPLICATORS

[75] Inventor: Martin A. Smith, Atlanta, Ga.

[73] Assignee: Pave-Mark Corporation, Atlanta, Ga.

[21] Appl. No.: 631,325

[22] Filed: Jul. 16, 1984

[51] Int. Cl.[4] ..... E01C 23/16

[52] U.S. Cl. ..... 404/93; 404/94; 126/343.5 A; 427/137; 427/286; 427/422; 118/305; 239/135

[58] Field of Search ..... 404/93, 94, 95; 432/10, 432/225, 226, 230; 126/343.5 A, 343.5 R; 239/172, 135, 150, 130; 118/305; 427/137; 222/146.2, 146.5

[56] References Cited

U.S. PATENT DOCUMENTS

| | | | |
|---|---|---|---|
| 1,468,365 | 9/1923 | Johnston | 404/95 |
| 1,855,961 | 4/1932 | Hargrave | 126/343.5 R |
| 2,041,359 | 5/1936 | Littleford | 126/343.5 |
| 2,648,264 | 8/1953 | Green | 404/107 |
| 2,728,336 | 12/1955 | Elgeti | 126/343.5 |
| 3,266,392 | 8/1966 | Angelini | 404/94 |
| 3,362,399 | 1/1968 | Lindenfeld | 126/343.5 R |
| 3,443,494 | 5/1969 | Boettler | 404/94 |
| 3,554,449 | 1/1971 | Currie | 404/94 |
| 4,101,058 | 7/1978 | Smith | 222/274 |

*Primary Examiner*—James A. Leppink
*Assistant Examiner*—Matthew Smith
*Attorney, Agent, or Firm*—Thomas & Kennedy

[57] ABSTRACT

A preheater for melting a slab of thermoplastic marking material preparatory to applying a melt therefrom onto a paved surface has a heated slab receiver formed with a side wall oriented between 70° and 82° with respect to a reference ground plane upon which surface a slab may be flushly supported for heating and melt down.

3 Claims, 9 Drawing Figures

PREHEATER FOR ROAD STRIPE APPLICATORS

TECHNICAL FIELD

This invention relates generally to applicators used in applying hot thermoplastic materials to paved surfaces such as roads, and particularly to preheaters employed by such applicators in melting thermoplastic material supplied in block or slab form preparatory to application.

BACKGROUND OF THE INVENTION

Paved surfaces such as concrete and asphalt roads are today marked with stripes to denote vehicular lanes and stop lines. The material used for such markings is typically an alkyd, epoxy or hydrocarbon thermoplastic which is applied in a molten form to the paved surface and then allowed to set and bond. Mobile applicators used in applying such thermoplastic materials are commonly referred to as road stripers. Some stripers are hand propelled while others are self propelled. As exemplified by the striper disclosed in U.S. Pat. No. 3,362,399 these applicators typically have a carriage or housing mounted upon a set of wheels in which a reservoir is housed and heated for containing a supply of the marking material in its molten state. The material is dispensed from the reservoir and onto a paved surface beneath the carriage through an extruder or sprayer. For efficiency of application the thermoplastic material is purchased in batch, solidified form, typically in the shape of a rectangular block or slab. Though the slabs, which sometimes are referred to as cakes, can be placed directly into the heated reservoir for melt down, it is more efficient to melt them in a preheater and then to channel the melt into the reservoir which may already contains a supply of the marking material in its molten state.

Road striper preheaters have heretofore typically comprised an upright, rectangular receiver or holder mounted vertically within a casing with the space between the receiver and casing providing a hot gas flow chamber. One or more fire tubes extends into this chamber from a supply tank of combustable fuel such as propane. By dropping a slab of the thermoplastic marking material into the receiver from ambience, and by igniting a flow of gas emitted through orifices in the fire tubes, heat generated and circulated through the gas flow chamber is transferred to the walls of the receiver and then to the slab, thereby causing it to melt. The flow of molten material is channelled out of an open bottom of the receiver into the reservoir where it is maintained in a molten state by other propane burner means until applied by an extruder or sprayer onto the surface of the roadway over which the applicator is moved.

Though preheaters of the type just described have functioned satisfactorily they do take significant periods of time to complete the melting of slabs. Such periods can provide loss times thereby restricting the efficiency of marking operations both from direct application time loss as well as from an excessive consumption of burner fuel.

SUMMARY OF THE INVENTION

It has now been discovered that the just described problem can be alleviated to a surprisingly high degree by orienting the preheater receiver, or at least one of its upright sides, along an inclined plane. In one preferred form of the invention, apparatus for melting a slab of thermoplastic marking material preparatory to applying a melt therefrom onto a paved surface comprises a carriage movable supported upon a set of wheels that collectively define a ground plane, and slab receiver means for receiving and holding generally upright a slab of thermoplastic marking material along a planar side support located in a side support plane inclined between approximately 70° and 82° with respect to the ground plane. The apparatus further includes heater means for heating the receiver means.

In another preferred form of the invention, apparatus for melting a slab of thermoplastic marking material preparatory to appying a melt therefrom onto a paved surface comprises a combustion gas flow chamber and means for movably supporting the combustion chamber upon a paved surface lying in a ground plane. A tubular receiver is mounted at least partially within the chamber which receiver has a substantially planar side support wall inclined between approximately 70° and 82° with respect to the ground plane. The apparatus further includes means for introducing combustable gases into the combustion gas flow chamber for combustion to heat the receiver.

In yet another form of the invention apparatus for melting slabs of thermoplastic marking material preparatory to applying melts therefrom onto a paved surface comprises a combustion gas flow chamber and wheel means for movably supporting the combustion chamber upon a paved surface located in a ground plane. A pair of tubular receivers is mounted side by side within the chamber with each receiver having a side support wall located between approximately 70° and 82° with respect to the ground plane. The apparatus further includes means for introducing combustable gases into the combustion gas flow chamber for heating the pair of receivers.

DETAILED DESCRIPTION

Figure 1:
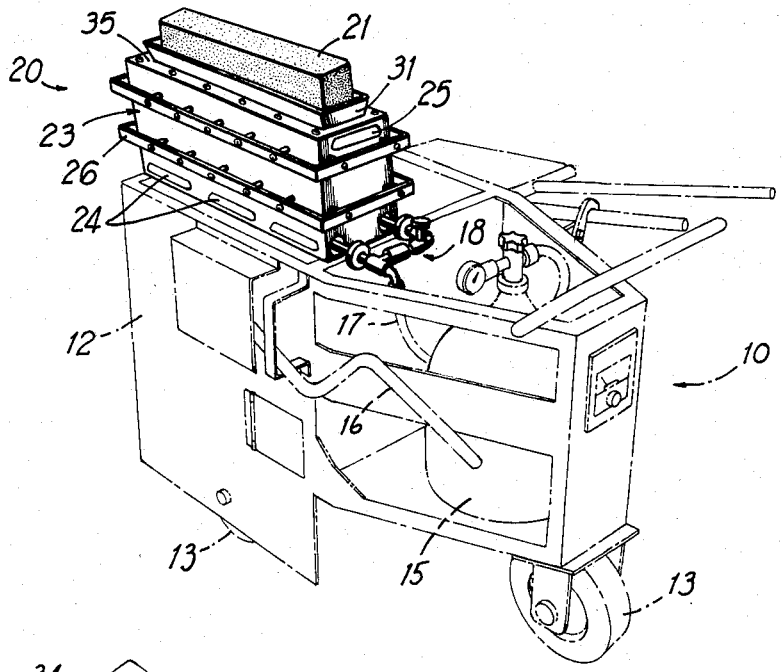
FIG. 1 is a perspective view of a preheater embodying principles of the present invention shown mounted to a road surface striper.

With reference next to the drawing, there is shown in FIG. 1 a paved surface or road striper 10 which has a main body frame in the form of a housing or carriage 12 movably supported by three triangularly arranged wheels 13 upon an unshown, flat road surface. The three wheels collectively define a ground plate at their three points of contact with the surface. The striper housing carries a propane tank 15 from which a gas line 16 extends to unshown burner means for heating an unshown main reservoir while another, flexible gas line 17 extends from the tank to a manifold 18. The striper is also seen to include a preheater indicated generally at 20, to which the manifold 18 is mounted, in which a slab 21 of thermoplastic marking material is held.

Figure 2:
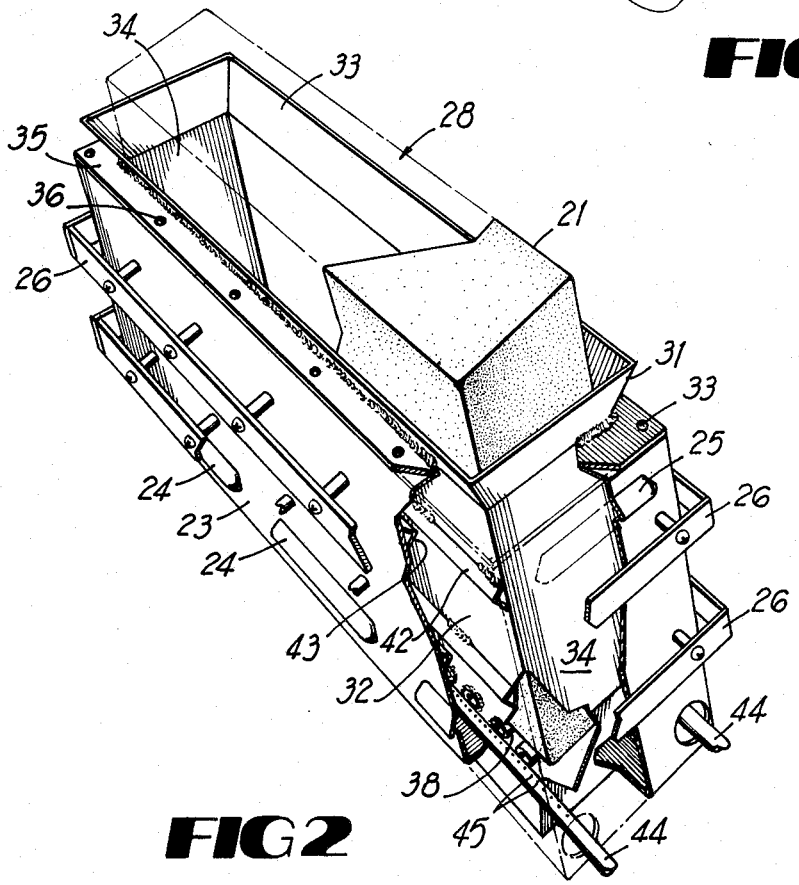
FIG. 2 is a perspective view of the preheater illustrated in FIG. 1 shown removed from the main body or carriage of the roadway striper.
Figure 3:
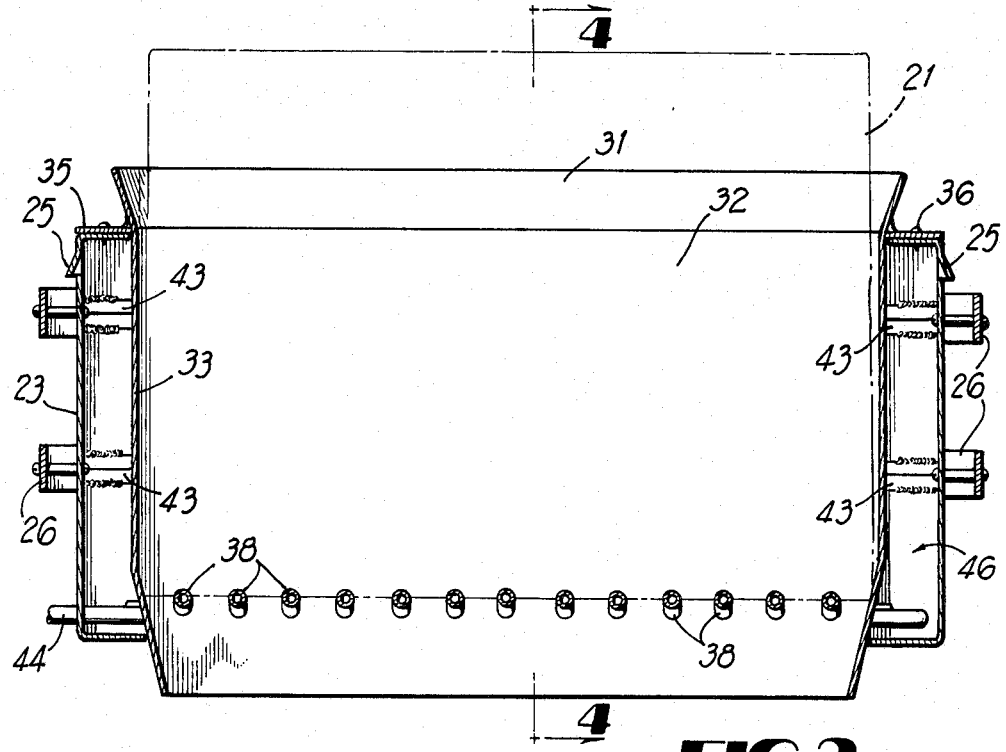
FIG. 3 is a cross-sectional view of the preheater illustrated in FIG. 1 taken along plane 3—3.
Figure 4:
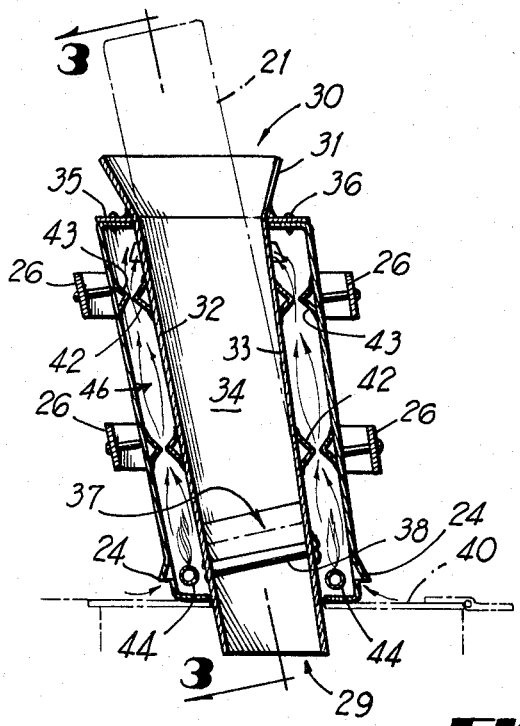
FIG. 4 is a cross-sectional view of the preheater illustrated in FIG. 2 taken along plane 4—4.

As best seen in FIGS. 2–4 the preheater itself comprises a casing 23 having six intake vents 24 formed in a lower portion thereof and two exhaust vents 25 formed in an upper portion thereof. Two protective ribs 26, which may also serve as handles, are mounted to the casing so as to surround it completely. As best shown in FIG. 4, the casing is mounted to the striper carriage or housing 12 with its two principal side walls oriented along inclines that are almost parallel with each other and with its top and bottom oriented parallel with the ground plane. A slab receiver or holder, indicated generally at 28, is seen to be mounted within the casing. The receiver is of tubular configuration having an open lower end 29 and an open upper end 30 which is formed by a funnel-shaped collar 31. A flange 35 extends outwardly from the juncture of the collar portion with the main body of the receiver which flange is mounted by screws 36 to the top of the casing. The receiver has a planar, inclined slab support downside wall 32, an opposite upside wall 33, and two end walls 34. These walls of the receiver 28 are located parallel with adjacent walls of the casing 23 to provide therebetween a hot gas flow chamber 46.

The receiver 28 is also seen have a grate indicated generally at 37 which is formed by a set of open ended tubes 38 that traverse a lower portion of the receiver. The open ends of the tubes 38 communicate with the space about the receiver that serves as the combustion gas flow chamber. The grating is oriented substantially normal to the receiver downside wall 32 which itself is oriented between 70° and 82° with respect to the ground plane defined by the three point contact of the striper wheels with the flat surface upon which the striper may be located. Two angle iron type bars 42 are mounted to the receiver downside wall 32 and two more are mounted to the upside wall. These bars face other angle iron type bars 43 that are mounted to the inside of the casing. These bars provide two functions, namely that of acting as strengthening members and that of acting as restrictors for the upward flow of heated combustion gases. Finally, the preheater is seen to comprise two fire tubes 44 that extend from the manifold 18 into the air flow chamber 46. Each fire tube is formed with a set of orifices 45 from which flames rise upon the ignition of propane gas exiting therefrom.

For operation a slab or cake 21 of thermoplastic pavement marking material, such as that sold by the Pave Mark Corporation of Smyrna, Ga., is dropped into the receiver 20 through its upper open end 30 and down upon the inclined downside wall 32 towards the grate 37. Due here to a slight convergence of the receiver upside and downside walls as they approach the grate, the bottom of the slab becomes lodged within the receiver just above the grate. With propane gas being fed from the tank 15 through gas line 17 and manifold 18 and into the fire tubes 44, and with the propane being ignited as it exits the orifices 45 along the fire tubes within the gas flow chamber and fed with oxygenated air supplied thereto through intake vents 24, hot combusted gases are formed within a lower portion of the chamber 46. These gases slowly rise through the chamber and through the flow restrictions provided by the confronting bars 42 and 43 upwardly from the fire tubes 44 and intake vents 24 all about the receiver and then out of the exhaust vents 25 in an upper portion of the casing. The heat generated by the combusted gases is conducted through the receiver walls and to the slab of thermoplastic material causing it to melt from its bottom upwardly. Due to the incline of the downside slab support wall 32 one side of the slab is maintained by gravity in intimate, flush, sliding contact with this inclined support wall. Thus, excellent heat conduction occurs between the slab of material and the receiver which serves to accelerate slab melting. With the slight taper between the upside and downside receiver walls both sides of the bottom of the slab are in direct wall contact.

Shortly after some initial melting the bottom of the slab comes into contact with the series of pipes 38 that form grate 37. As these pipes are open ended and proximal to the fire tubes, some of the combusted gases within the gas flow chamber may also pass through the pipes thereby enhancing thermal conduction. The grate thus, in turn, applies more heat by a mixture of conduction and convection. In this respect the term grate does not strictly mean a holding device although it does prevent a solid slab from passing through the receiver. As melting continues the slab decends further into the receiver until it has been completely melted. The molten material flows down out of the open lower end 29 of the receiver and is guided to the unshown heated reservoir for subsequent extrusion or spraying onto the surface of the pavement located beneath the striper.

The location of the downside slab support wall 32 at an incline of between 70° and 82° has proved to be surprisingly effective in reducing melt down time for receivers that have their opposite or upside support wall parallel or almost parallel therewith. This is unexpected due to the fact that one would think that such an inclination would merely produce a more intimate contact of the slab (and thus better thermal conductivity) with the downside wall at a correspondent sacrifice in intimacy or spacing of the slab with the upside receiver wall. However, actual tests have shown this not to be true. Tests conducted with a preheater of the type just described produced the following results:

| Inclinations (in degrees) | Meltdown Time (in minutes) A | B |
|---|---|---|
| 90° | 29 | 24 |
| 86° | 25 | 20 |
| 84° | 23 | 16 |
| 82° | 18 | 11 |
| 76° | 19 | 12 |
| 70° | 22 | 13 |
| 67° | 29 | 17 |
| 65° | 35 | 20 |

The times in column A were measured with the main reservoir empty while those in column B were measured with the main reservoir a little over one third filled with molten material.

Figure 5:
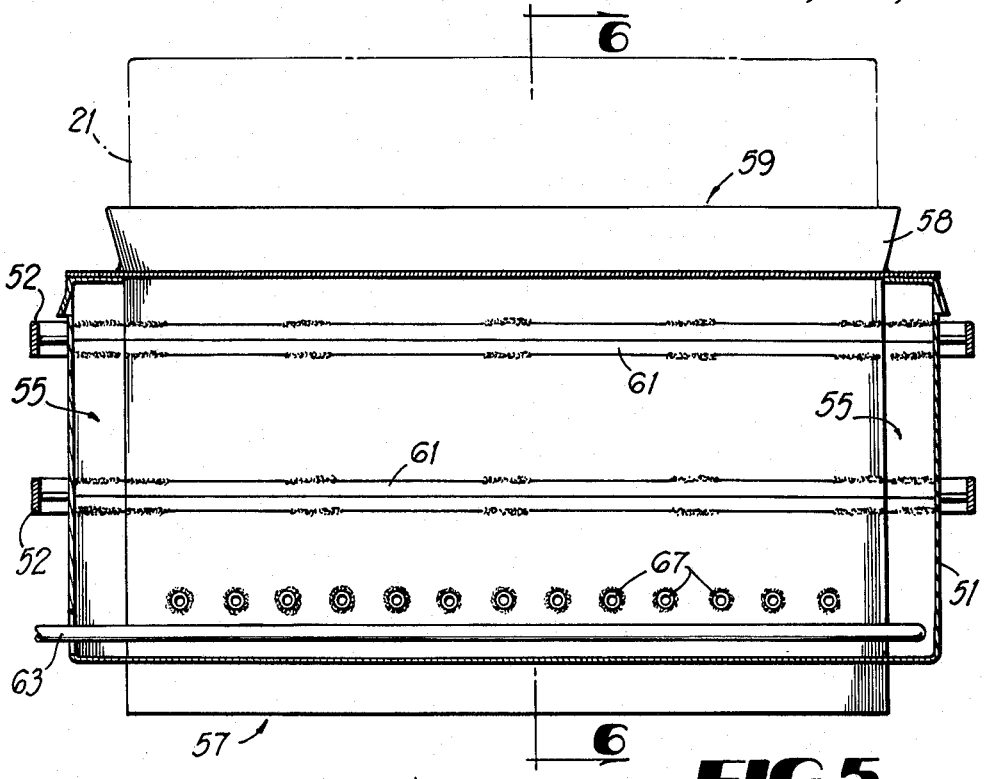
FIG. 5 is a cross-sectional view taken along plane 5—5 of a preheater embodying principles of the invention in an alternative form.
Figure 6:
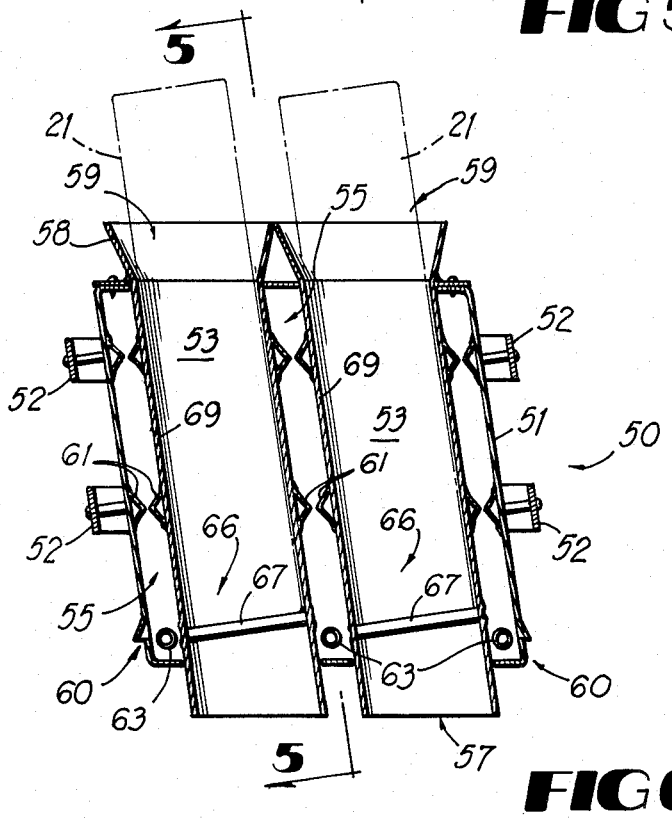
FIG. 6 is a cross-sectional view of the preheater illustrated in FIG. 5 taken along plane 6—6.

With reference next to FIGS. 5 and 6, a preheater for a roadway striper is shown which embodies priciples of the invention in an alternative form. Here, a preheater 50 is seen to comprise a casing 51 having two casing encompassing protective ribs 52. This preheater has two slab receivers or holders 53 of identical configuration ganged together within the casing 51 to provide a gas flow chamber 55 between the casing walls and the walls of the two receivers. The space between the two receivers communicates with spaces between the walls of the casing and each receiver. Again, each receiver has an open lower end 57 through which a melt from slabs may gravitate and a funnel-shaped collar 58 providing an open upper end 59. The casing 51 is formed with air intake vents 60 at its lower end and unshown exhaust vents near its upper end. Angle iron type bars 61 are mounted to the walls of the casing and receivers facing one another to provide restricted channels therebetween to slow the flow of heated gases upwardly through the gas flow chamber. Three fire tubes 63 extent into the lower portion of the gas flow chamber through the walls of the casing with two of the fire tubes straddling the gang of two slab receivers while the third is positioned between the receivers.

Operation of the preheater 50 is similar to that previously described except that in this case two slabs 21 of thermoplastic marking material may be simultaneously or sequentially dropped into the open ends of the receivers and, in this case, placed immediately atop the two grates 66 formed by a series of open ended pipes 67 that transverse lower portions of the two receivers since the receiver side walls here do not converge. Slow upward movement of heated gases from the fire tubes to the exhaust vents, causes the two receivers to be heated as well as the two slabs of thermoplastic material held therein. With the downside walls 69 also located here along planes inclined between 70° and 82° with respect to the ground plane of the striper, thermal conduction between these side support walls 69 and the slabs 21, which rest in intimate contact thereagainst, enhances the speed of melt down. The ganging together of two receivers which may, for example, accept slabs 21 of the same size and shape as that accepted by the receiver in the previously described embodiment, provides for a very efficient use of fuel and a very short melt down time preparatory to the application of the thermoplastic marking material to the surface of a roadway in molden form.

Figure 7:
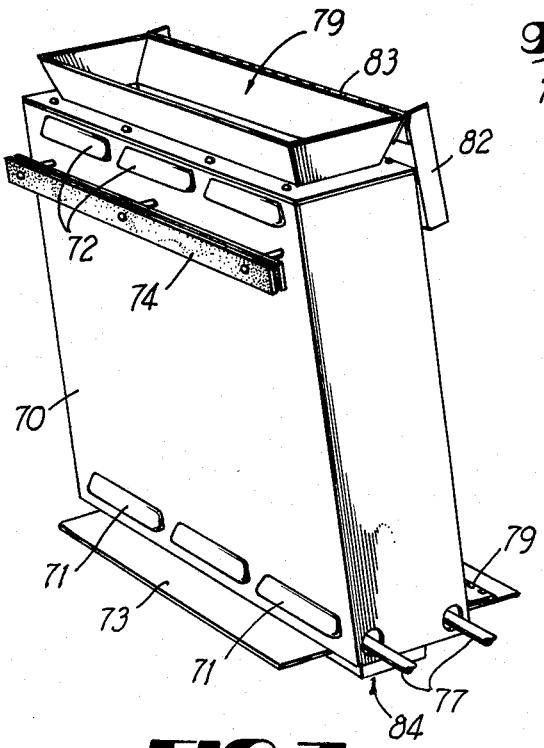
FIG. 7 is a perspective view of a preheater embodying principles of the invention in yet another form.
Figure 8:
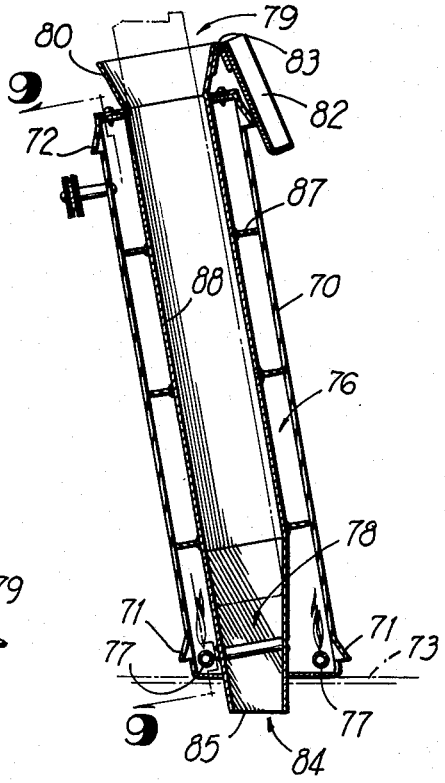
FIG. 8 is a cross-sectional view of the preheater illustrated in FIG. 7.
Figure 9:
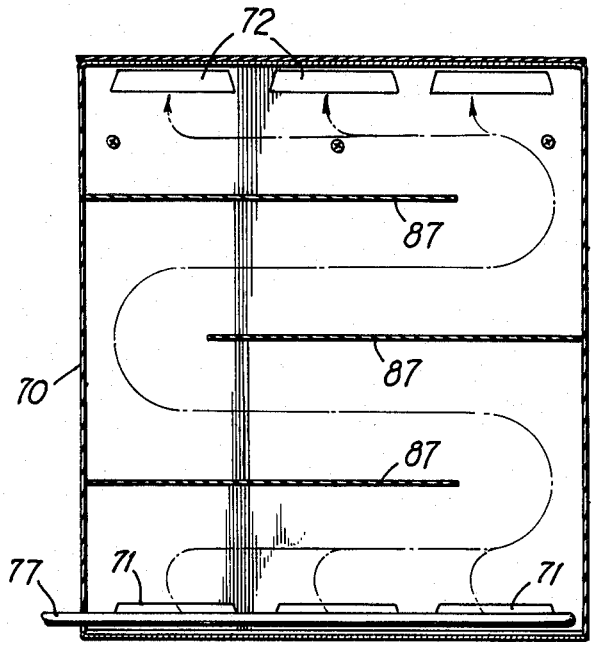
FIG. 9 is a cross-sectional view of the preheater illustrated in FIGS. 7 and 8 taken along plane 9—9.

With reference next to FIGS. 7–9 a preheater for a roadway striper is shown in yet another form. Here, the preheater comprises a casing 70 having air intake vents 71 formed in a lower portion thereof and exhaust vents 72 formed in an upper portion thereof. The casing extends upwardly along an incline of between 70° and 82° with respect to a lower flange 73 which flange is mounted to the striper carriage so as to orient the flange parallel with the ground plane defined by the point of tangency of the striper wheels 13 with respect to the surface upon which the striper is movably supported for marking. A protective rib 74 is mounted to each principle side of the casing. A slab receiver 75 is mounted within the casing thereby providing an air flow chamber 76 between the walls of the receiver and casing. Two fire tubes 77 extend into a lower portion of the casing adjacent a grate 78 that is in the form of an array of open ended tubes that traverse a lower portion of the receiver. The upper open end 79 of the receiver is formed with a chute or funnel-like collar 80. This open end may be temporarily closed by a lid 82 that is pivotably mounted along one side of the collar 79 by a hinge 83. The flange 73, which normally rests upon a support surface of the striper carriage, is secured to a hinge 79 so that the preheater may be pivoted on occasion to gain access to the main striper reservoir located therebeneath. The lower open end 84 of the receiver is seen to have a lip 85 oriented parallel with and below the flange 73.

In this embodiment the flow of hot gases from the lower portion of the casing upwardly to the exhaust vents, rather than being restrained by confronting bar restrictions, is instead diverted freely along a serpentine route between baffles 87 mounted to the sides of the receiver. Otherwise, the operation of this embodiment is quite similar to those previously described with the exception that here the open upper end 80 may be temporarily closed by pivotable movement of lid 82 once the slab has melted down sufficiently to permit such. Due to an angle of inclination of the side support wall 88 of between 70° and 82° with respect to the striper ground plane, the lid 82 may be placed against and slid upon the slab itself as it slowly descends from melting. In this case the lid would automatically close off the top of the receiver once the slab no longer projects out of the collar. With the top closed additional heat is retained within the receiver for enhanced efficiency.

It thus is seen that preheaters for a paved surface striper are provided which alleviate problems experienced with those of the prior art. Though the preheaters illustrated have been for stripers, they may also be mounted above a heating kettle used to liquify thermoplastic marking material prior to introduction into a striper. It thus should be understood that the embodiments described merely illustrate principles of the invention in preferred forms. Many modifications, additions and deletions may thus be made thereto without departure from the spirit and scope of the invention as set forth in the following claims.

I claim:

1. Apparatus for melting a slab of thermoplastic marking material preparatory to applying a melt therefrom onto a paved surface, and with said apparatus comprising a combustion gas flow chamber, means for movably supporting said combustion chamber upon a paved surface lying in a ground plane; a tubular receiver mounted at least partially within said chamber and having a substantially planar side support wall inclined between approximately 70° and 82° with respect to said ground plane; a second tubular receiver mounted at least partially within said chamber beside said tubular receiver, said second receiver having a substantially planar side support wall located adjacent said tubular receiver and parallel with said tubular receiver side support wall, a set of open ended tubes traversing a lower portion of each of said tubular receivers upon which slabs of thermoplastic material may be supported within said receivers, and means for introducing combustable gases into said combustion gas flow chamber for combustion to heat said receivers.

2. Apparatus for melting slabs of thermoplastic marking materials preparatory to applying melts therefrom onto a paved surface, and with said apparatus comprising a combustion gas flow chamber, wheel means for movably supporting said combustion chamber upon a selected ground plane, a pair of tubular receivers mounted side by side within said chamber with each receiver having a side support wall oriented between approximately 70° and 82° with respect to said ground plane; and means for introducing combustable gases into said combustion gas flow chamber for combustion to heat said pair of receivers and which comprises a central fire tube mounted within said chamber between said pair of receivers and a pair of fire tubes mounted within said chamber straddling said pair of receivers.

3. The apparatus of claim 2 comprising a plurality of open ended tubes traversing a lower portion of each of said receivers to provide a grate within each receiver, and wherein each open end of each tube is located adjacent one of said fire tubes.

* * * * *